United States Patent [19]

Schultz

[11] Patent Number: 4,684,242

[45] Date of Patent: Aug. 4, 1987

[54] MAGNETIC FLUID CLEANING STATION

[75] Inventor: Peter G. Schultz, Fairport, N.Y.

[73] Assignee: Eastman Kodak Company, Rochester, N.Y.

[21] Appl. No.: 822,375

[22] Filed: Jan. 27, 1986

[51] Int. Cl.[4] ..... G03G 21/00

[52] U.S. Cl. ..... 355/15; 355/30

[58] Field of Search ..... 355/3 R, 3 BE, 15, 30

[56] References Cited

U.S. PATENT DOCUMENTS

| | | | |
|---|---|---|---|
| T893,001 | 12/1971 | Fisler | 355/15 X |
| 3,483,034 | 12/1969 | Ensminger | 134/1 |
| 3,620,800 | 11/1971 | Tamai et al. | 355/15 X |
| 3,791,730 | 2/1974 | Sullivan | 355/3 DD |
| 4,043,298 | 8/1977 | Swackhammer | 355/15 X |
| 4,080,059 | 3/1978 | Tani et al. | 355/15 |
| 4,111,546 | 9/1978 | Maret | 355/15 |
| 4,165,172 | 8/1979 | Okamoto et al. | 355/15 |
| 4,252,435 | 2/1981 | Manghirmalani | 355/15 |
| 4,361,397 | 11/1982 | Katakura et al. | 355/15 |
| 4,459,012 | 7/1984 | Allen et al. | 355/15 |
| 4,499,849 | 2/1985 | Tomita et al. | 355/15 X |
| 4,505,577 | 3/1985 | Koizumi | 355/15 |
| 4,571,070 | 2/1986 | Tomita | 355/15 |

OTHER PUBLICATIONS

*Magnetic Fluid Seals*, R. E. Rosensweig et al, Machine Design, Mar. 28, 1968, pp. 145–150.

*Primary Examiner*—Fred L. Braun

*Attorney, Agent, or Firm*—Milton S. Sales

[57] ABSTRACT

An electrographic copier has a moveable dielectric member, a developing station for applying toner to selected areas of the dielectric member, and cleaning apparatus for removing residual toner from the dielectric member. The cleaning apparatus includes wall structure defining a cavity open to the dielectric member, and having close-clearance gap regions between the wall structure and the dielectric member magnetically permeable cleaning fluid fills the cavity. Magnetic field producing structure magnetically coupled through the cleaning fluid in the gap regions forms a magnetic seal in the gap regions, thereby inhibiting leakage of the cleaning fluid from the cavity through the gap regions.

8 Claims, 4 Drawing Figures

MAGNETIC FLUID CLEANING STATION

BACKGROUND OF THE INVENTION

1. Field of the Invention

This invention relates to cleaning apparatus for removing toner from dielectric members of copiers.

2. Description of the Prior Art

Modern high-speed electrographic copiers make document reproductions by exposing an electrically-charged dielectric member to a light image of the document. The light image selectively discharges the dielectric member to form a latent image charge pattern corresponding to the document. An oppositely charged developer material is brought into contact with the latent image to develop the image. The developed image is then transferred to a receiver sheet and fixed to the sheet by heat and/or pressure to yield the desired copy.

The developer material includes a resinous powder known as toner. If the toner is not completely transferred to the receiver sheet, the residual toner may scatter throughout the copier and contaminate other components within the copier. It is, therefore, standard practice to include apparatus for cleaning the dielectric member immediately after the image is transferred from the dielectric member to the receiver sheet.

A typical cleaning apparatus for a dielectric member is shown in commonly assigned U.S. Pat. No. 4,459,012, which issued on July 10, 1984 to J. D. Allen et al. Briefly, a rotating bristle brush sweeps residual toner from a photoconductive dielectric member. A source of vacuum establishes an air flow which transports toner from the brush to filter apparatus.

Because the surface of a dielectric member is relatively soft and easily abraded, extreme care must be taken to not harm the surface. While brushes and other surface-contacting means of suitably soft material are generally effective to remove residual toner, they do require a great frequency of maintenance, have the potential for creating an undesirable dust condition, and can malfunction to the extent of abrading the surface of the dielectric member.

Various techniques have been tried in order to overcome the disadvantages associated with brush cleaning. One such attempt is shown in U.S. Defensive Publication Pat. No. T 893,001, which was published on Dec. 14, 1971, in the name of J. D. Fisler. In the Fisler disclosure, toner is removed from the photoconductive dielectric member by contact with a fluid medium through which ultrasonic energy is transmitted. Although cleaning by such means may be effective and is achieved without adversely affecting the dielectric member, the location of the cleaning station is restricted to those regions around the dielectric member where the cleaning fluid can drain directly from the dielectric member into a sump for filtration and recirculation. For example, U.S. Pat. No. 3,483,034, which issued Dec. 9, 1969 to D. Ensminger, shows a fluid photoconductive dielectric member cleaning station at the bottom of the dielectric member. However, in many electrographic copier configurations, positioning the cleaning station at such a region would be inconvenient.

Dielectric member cleaning using a fluid has been proposed at positions other than at the bottom of the dielectric member, such as shown in U.S. Pat. No. 4,165,172, which issued on Aug. 21, 1979 to T. Okamoto et al. In such applications, the cleaning fluid is prevented from running down the dielectric member by a blade member in contact with the surface of the dielectric member. However, the blade negates the advantages of the fluid cleaning insofar as prevention of the risk of abrading the surface of the dielectric member is concerned.

SUMMARY OF THE INVENTION

It is an object of the present invention, to provide an electrographic copier wherein residual toner particles remaining on the dielectric member after image transfer can be effectively removed by a fluid material at a cleaning station (1) positionable without regard to drainage of the fluid from the surface of the dielectric member and (2) without relying upon physical members to confine the fluid material. Thus, the adverse effects of rotating brush or other types of dielectric member contacting apparatus can be overcome without total redesign of the electrographic copier configuration. This object is accomplished, in part, by magnetically confining the fluid material at the surface of the dielectric member at the cleaning station. The fluid contains small particles of magnetic material to make the fluid magnetically permeable and responsive to an applied magnetic field.

In accordance with a preferred embodiment of the present invention an electrographic copier includes a cleaning apparatus for removing residual toner particles from the photoconductive dielectric member. The cleaning apparatus comprises a cavity open to the dielectric member and containing magnetically permeable fluid. There are close-clearance gap regions between the cavity walls and the dielectric member. Magnetic field producing means establish a magnetic circuit through the magnetically permeable fluid in the gap regions such that the fluid is confined within the cavity. In accordance with the invention, residual toner particles are removed from the dielectric member without imparting damage to the member. Toner and other contaminates will build up in the fluid, and must be removed. In a preferred embodiment of the present invention, such contaminates are removed by filtering, centrifugal, and/or magnetic methods.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

Because electrographic copiers are well known, the present description will be directed in particular to elements forming part of, or cooperating directly with, apparatus in accordance with the present invention. It is to be understood that elements not specifically shown or described may take various forms well known to those skilled in the art.

Figure 1:
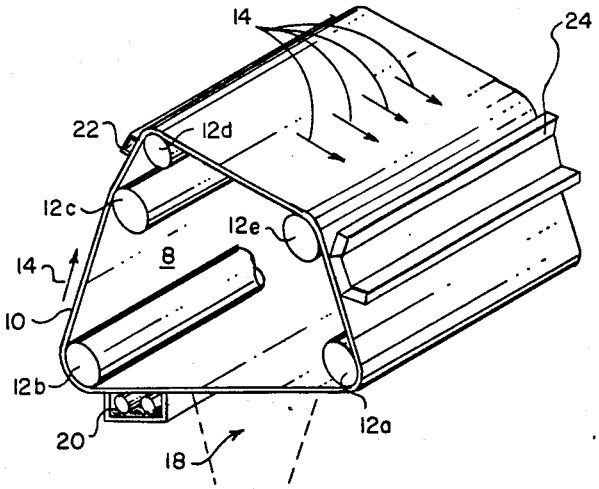
FIG. 1 is a perspective view of a portion of a conventional electrographic copier showing various processing stations including cleaning apparatus.

Referring now to the drawings, FIG. 1 shows a portion of a conventional electrographic copier 8 having a flexible transparent dielectric member which, in the preferred embodiment, is a photoconductive member 10 supported on rollers 12*a*–12*e* for movement about a closed loop path in the direction of arrows 14. In an electrographic cycle, photoconductive member 10 is electrically charged by a primary charger (not shown) just before the photoconductive member passes through an exposure station 18. In exposure station 18, a section of photoconductive member 10 is exposed to a light image of the document to be copied to selectively discharge the member in an imagewise configuration, producing a latent image of the document on photoconductive member 10. In a developer station 20, the latent image is developed by bringing toner into contact with charged photoconductive member 10. The developed image is transferred to a receiver sheet (not shown) in a transfer station 22. Transfer station 22 applies a charge to the sheet to attract the developed image from photoconductive member 10. A cleaning apparatus 24 removes residual toner from photoconductive member 10. Residual toner is that toner which failed to transfer from photoconductive member 10 to the receiver sheet.

Figure 3:
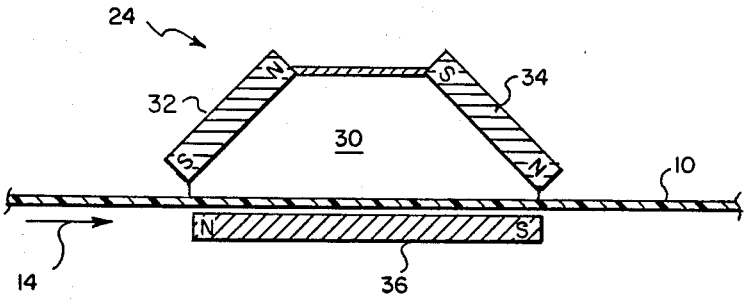
FIG. 3 is a sectional view of a portion of the cleaning station of FIG. 2.
Figure 2:
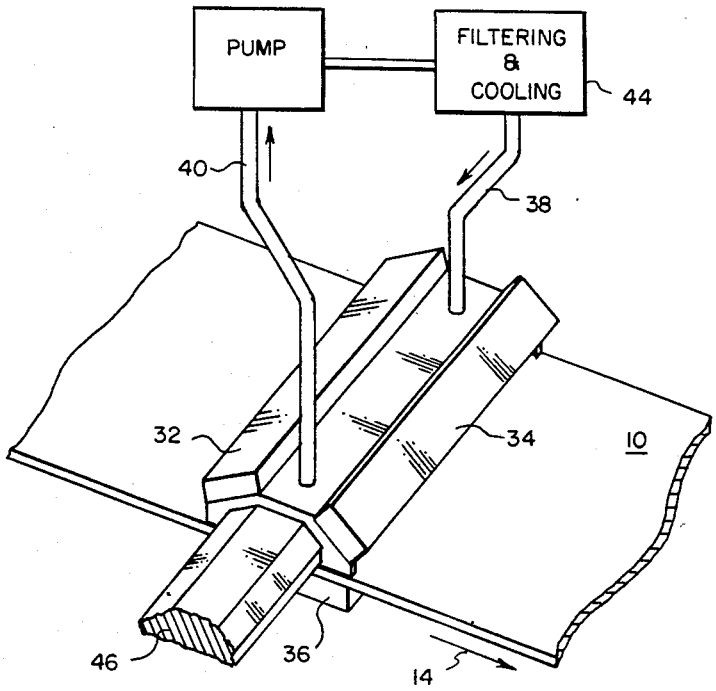
FIG. 2 is a perspective view of a magnetic fluid cleaning station in accordance with the present invention.

FIGS. 2 and 3 are perspective and sectional views, respectively, of a first embodiment of the present invention. Photoconductive member 10 moves through cleaning station 24 in the direction of arrow 14. The cleaning station includes a cavity 30 open at one side to the photoconductive member. The cavity is defined, and has close-clearance gap regions between the wall means and the photoconductive member (exaggerated in the drawings for clarity). Magnetic field producing means include a pair of permanent magnets 32 and 34 for establishing a field across the gap regions. A ferromagnetic plate 36 which extends between magnets 32 and 34 closes the top of the cavity.

Magnets 32 and 34 extend laterally across photoconductive member 10, and the ends of cavity 30 are closed by shoes, one of which is shown in FIG. 2. While the gap regions between magnets 32 and 34 and the photoconductive member reduce the risk of abrasion of the photoconductive member's surface, the end shoes may contact the surface since such contact will be outside of the image areas. A third magnet 36 on the opposed side of photoconductive member 10 is a part of the field producing means and completes the magnetic circuit.

Magnetic fluid is circulated through chamber 30 through conduits 38 and 40. While in the chamber, the magnetic fluid is vibrated by an ultrasonic horn 46 to cause shear forces normal to the direction of movement of the photoconductive member.

Magnetic fluids are colloidal suspensions of magnetic particles in a liquid carrier. In colloidal suspensions, particles do not separate from the liquid carrier, even under high magnetic field gradients or shearing forces, and are retained in suspension by Brownian forces. A dispersing agent is absorbed onto the surface of each particle in the fluid, and this coating forms a repellent layer for other particles.

The typical particle size in these fluids is 100 angstroms (0.01 mm), which is so small that thermal agitation by impact of liquid molecules prevents the particles from settling or separating under the action of either gravity or strong magnetic fields. These colloidal suspensions behave mechanically like true, homogeneous fluids; but, in addition, they are highly susceptible to magnetic fields because of the magnetic particles.

In the absence of a magnetic field, the fluid is unmagnetized. When a field is applied, the fluid develops a magnetic moment colinear with the applied field. The fluids can be precisely positioned by an external magnetic field because the fluid acquires a magnetic moment due to the orientation of the magnetic particles in the fluid. The forces which hold the fluid in place are proportional to the magnetic field gradient and the magnetization value of the fluid.

The present invention takes advantage of the response of magnetic fluids to magnetic fields. The free surface of the magnetic fluid in the gap regions between photoconductive member 10 and magnets 32 and 34 map a surface of uniform magnetic-field magnitude. This creates a force retaining the magnetic fluid in the gaps, thereby sealing chamber 30.

As photoconductive member 10 passes through chamber 30, residue toner particles and other debris detach from the photoconductive member and are suspended in the magnetic fluid. These and other contaminants such as heat must be removed from the magnetic fluid, and I have provided filtering and cooling means 44 for this purpose. While paper fibers and other large particles may be filtered from the fluid, toner particles are approximately the same size as the magnetic particles, and must be removed by other means. Centrifugal and magnetic separation methods are suggested.

As can be seen in FIG. 3, there are two gap regions in the preferred embodiment. The upstream gap region, that between the photoconductive member and magnet 32, is slightly wider than the downstream gap region. This is useful to insure that the upstream gap region is wide enough to pass toner particles carried by photoconductive member 10. Since the toner particles are removed from the photoconductive member in chamber 30, the downstream gap region need not be as wide. Fortunately, the magnetic fluid in chamber 30 exerts less exiting force through the upstream gap region than through the downstream gap region because of the direction of movement of photoconductive member 10.

Figure 4:
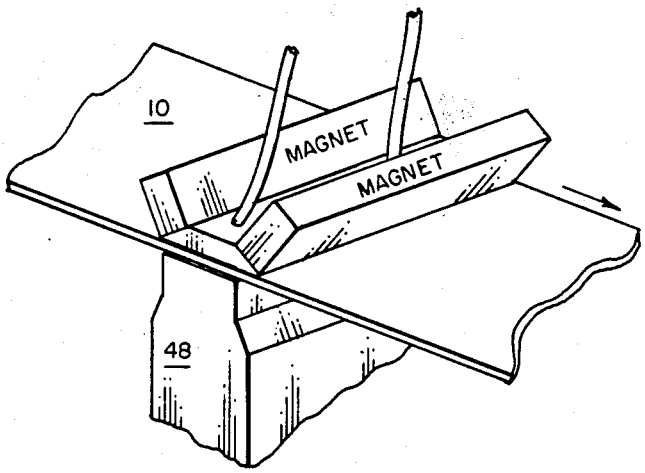
FIG. 4 is a perspective view similar to FIG. 2 of a second embodiment of the present invention.

In the embodiment shown in FIG. 4, there is no magnet under photoconductive member 10, but at least the tip of an ultrasonic horn 48 is formed of ferro-magnetic material and extends under the gap region to complete the magnetic circuit. The horn applies vibration to the back of photoconductive member 10. It will also be understood that the magnetic fluid can be vibrated by means other than an ultrasonic horn such as, for example, by piezoelectric or magnetic means.

The preferred embodiment of the present invention has been illustrated in a copier having a belt-type photoconductive member. It will be understood that the dielectric member may take other forms such as, for example, a rotating drum with a ferro-magnetic layer to complete the magnetic circuit.

The invention has been described in detail with particular reference to a preferred embodiment thereof, but it will be understood that variations and modifications can be effected within the spirit and scope of the invention.

I claim:

1. In an electrographic copier having a movable dielectric member, a station for applying toner to selected areas of the dielectric member, a transfer station whereat most of the applied toner is removed from the dielectric member, and cleaning apparatus for removing residual toner from the dielectric member; the improvement wherein said cleaning apparatus comprises:

wall means defining a cavity open to the dielectric member, and having close-clearance gap regions between said wall means and the dielectric member;

means for supplying magnetially permeable cleaning fluid to said cavity; and magnetic field producing means magnetically coupled through said cleaning fluid in said gap regions to form a magnetic seal in said gap regions, thereby inhibiting leakage of said cleaning fluid from said cavity through said gap regions.

2. The improvement as defined in claim 1 wherein said magnetically permeable cleaning fluid contains small particles of magnetic material.

3. The improvement as defined in claim 1 wherein said cleaning apparatus further comprises means for removing contaminates from said cleaning fluid.

4. The improvement as defined in claim 3 wherein said supply means includes means for circulating cleaning fluid between said cavity and said means for removing contaminates.

5. The improvement as defined in claim 1 wherein said supply means includes means for circulating cleaning fluid through said cavity.

6. The improvement as defined in claim 1 wherein there is a first gap region where the dielectric member enters said cavity and a second gap region where the dielectric member leaves said cavity, said second gap region being narrower than said first gap region in a direction normal to the dielectric member.

7. The improvement as defined in claim 1 further comprising means for vibrating the cleaning fluid within said cavity.

8. The improvement as defined in claim 7 wherein said vibrating means is an ultrasonic horn.

* * * * *